US005683337A

United States Patent [19]

Zetocha et al.

[11] Patent Number: 5,683,337

[45] Date of Patent: Nov. 4, 1997

[54] ROTARY EXERCISE MACHINE

[76] Inventors: Martin Zetocha; Jozef Zetocha, both of 2223 Shipwright Rd., Oakville, Ontario, Canada, L6M 3E2

[21] Appl. No.: 663,749

[22] Filed: Jun. 14, 1996

[51] Int. Cl.[6] ..... A63B 22/14

[52] U.S. Cl. ..... 482/146

[58] Field of Search ..... 482/146, 147, 482/114, 118, 119, 65

[56] References Cited

U.S. PATENT DOCUMENTS

| | | | |
|---|---|---|---|
| 3,021,137 | 2/1962 | Palmer et al. | 482/118 X |
| 3,593,994 | 7/1971 | Anbar | 482/147 |
| 5,062,633 | 11/1991 | Engel et al. | 482/118 |
| 5,154,684 | 10/1992 | Delf | 482/118 X |
| 5,358,463 | 10/1994 | Fuentes | 482/147 X |
| 5,433,690 | 7/1995 | Gilman | 482/146 |

*Primary Examiner*—Richard J. Apley
*Assistant Examiner*—William LaMarca

[57] ABSTRACT

A new Rotary Exercise Machine for offering a more efficient and effective machine for exercising the deltoids, the pectorals, the external obliques, and the abdominus rectus, the quadriceps, and the calves of a human body. The inventive device includes a top plate, a bottom plate, a resistance plate, and a resistance knob. In use, after the Rotary Exercise Machine 10 is assembled and operable, the user stands upon the exposed surface of the top plate 20 and begins a twisting exercise motion. Upon a first try, the user then adjusts the tension of the Rotary Exercise Machine 10 by operation of the resistance knob 40. After adjusting the tension of the Rotary Exercise Machine 10, the user begins to exercise.

13 Claims, 3 Drawing Sheets

10
12
13
40
46
44
42
20
22
24
48
26
52
50
62
62
68
63
63
54
60
65
72
32
32
30
36
34
38

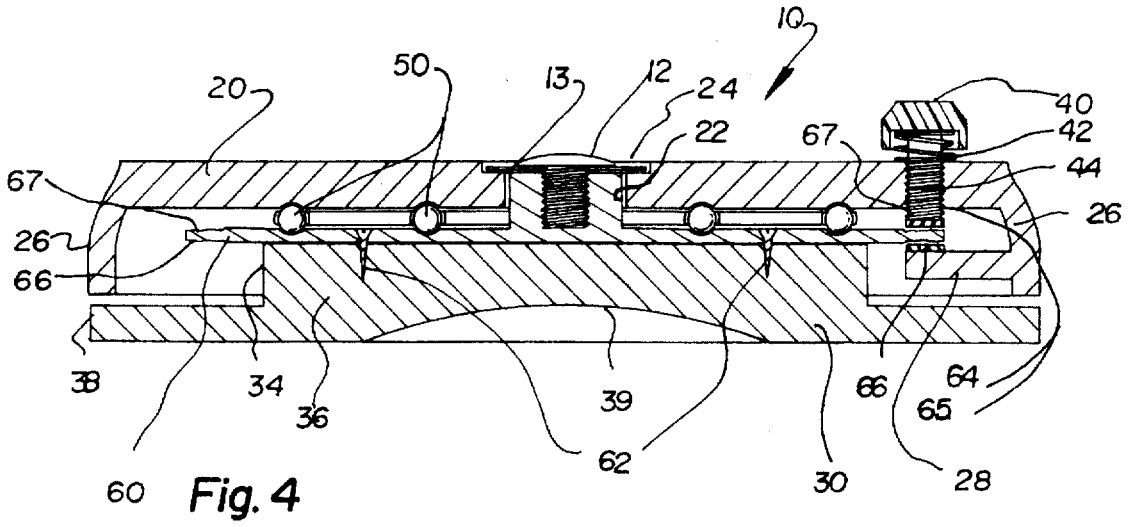
Fig. 4
Fig. 5
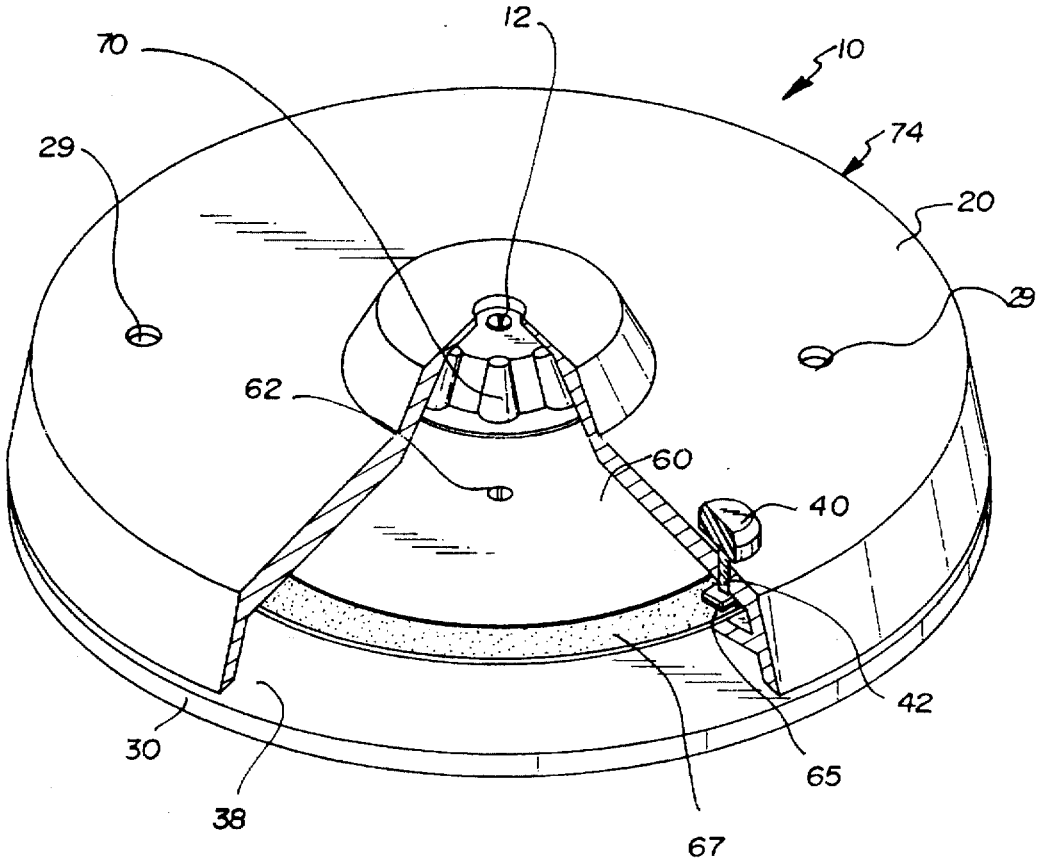

ROTARY EXERCISE MACHINE

BACKGROUND OF THE INVENTION

1. Field of the Invention

The present invention relates to aerobic and anaerobic exercise equipment and more particularly pertains to a new Rotary Exercise Machine for offering a more efficient and effective machine for exercising the deltoids, the pectorals, the external obliques, and the abdominus rectus, the quadriceps, and the calves of a human body.

2. Description of the Prior Art

The use of aerobic and anaerobic exercise equipment is known in the prior art. More specifically, aerobic and anaerobic exercise equipment heretofore devised and utilized are known to consist basically of familiar, expected and obvious structural configurations, notwithstanding the myriad of designs encompassed by the crowded prior art which have been developed for the fulfillment of countless objectives and requirements.

Known prior art aerobic and anaerobic exercise equipment include U.S. Pat. No. 5,433,690; U.S. Pat. No. 5,256,127; U.S. Pat. No. Des. 352,980; U.S. Pat. No. 5,399,140; U.S. Pat. No. 5,415,609; and U.S. Pat. No. 5,040,785.

While these devices fulfill their respective, particular objectives and requirements, the aforementioned patents do not disclose a new Rotary Exercise Machine. The inventive device includes a top plate, a bottom plate, a resistance plate, and a resistance knob.

In these respects, the Rotary Exercise Machine according to the present invention substantially departs from the conventional concepts and designs of the prior art, and in so doing provides an apparatus primarily developed for the purpose of offering a more efficient and effective machine for exercising the deltoids, the pectorals, the external obliques, and the abdominus rectus, the quadriceps, and the calves of a human body.

SUMMARY OF THE INVENTION

In view of the foregoing disadvantages inherent in the known types of aerobic and anaerobic exercise equipment now present in the prior art, the present invention provides a new Rotary Exercise Machine construction wherein the same can be utilized for offering a more efficient and effective machine for exercising the deltoids, the pectorals, the external obliques, and the abdominus rectus, the quadriceps, and the calves of a human body.

The general purpose of the present invention, which will be described subsequently in greater detail, is to provide a new Rotary Exercise Machine apparatus and method which has many of the advantages of the aerobic and anaerobic exercise equipment mentioned heretofore and many novel features that result in a new Rotary Exercise Machine which is not anticipated, rendered obvious, suggested, or even implied by any of the prior art aerobic and anaerobic exercise equipment, either alone or in any combination thereof.

To attain this, the present invention generally comprises a top plate, a bottom plate, a resistance plate, and a resistance knob.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Rotary Exercise Machine apparatus and method which has many of the advantages of the aerobic and anaerobic exercise equipment mentioned heretofore and many novel features that result in a new Rotary Exercise Machine which is not anticipated, rendered obvious, suggested, or even implied by any of the prior art aerobic and anaerobic exercise equipment, either alone or in any combination thereof.

It is another object of the present invention to provide a new Rotary Exercise Machine which may be easily and efficiently manufactured and marketed.

It is a further object of the present invention to provide a new Rotary Exercise Machine which is of a durable and reliable construction.

An even further object of the present invention is to provide a new Rotary Exercise Machine which is susceptible of a low cost of manufacture with regard to both materials and labor, and which accordingly is then susceptible of low prices of sale to the consuming public, thereby making such Rotary Exercise Machine economically available to the buying public.

Still yet another object of the present invention is to provide a new Rotary Exercise Machine which provides in the apparatuses and methods of the prior art some of the advantages thereof, while simultaneously overcoming some of the disadvantages normally associated therewith.

Still another object of the present invention is to provide a new Rotary Exercise Machine for offering a more efficient and effective machine for exercising the deltoids, the pectorals, the external obliques, and the abdominus rectus, the quadriceps, and the calves of a human body.

Yet another object of the present invention is to provide a new Rotary Exercise Machine which includes a top plate, a bottom plate, a resistance plate, and a resistance knob.

Still yet another object of the present invention is to provide a new Rotary Exercise Machine that aerobically exercises the user with a machine that is simpler to work.

Even still another object of the present invention is to provide a new Rotary Exercise Machine that can be set at varying degrees of resistance to adjust to user desires.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross sectional view taken along line 4—4 of FIG. 2.

FIG. 5 is a cutaway view of another embodiment of the present invention.

DESCRIPTION OF THE PREFERRED EMBODIMENT

Figure 1:
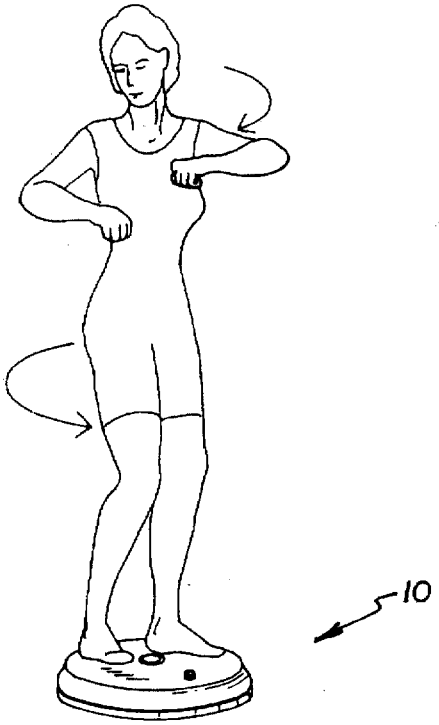
FIG. 1 is a front perspective view of a new Rotary Exercise Machine according to the present invention.
Figure 2:
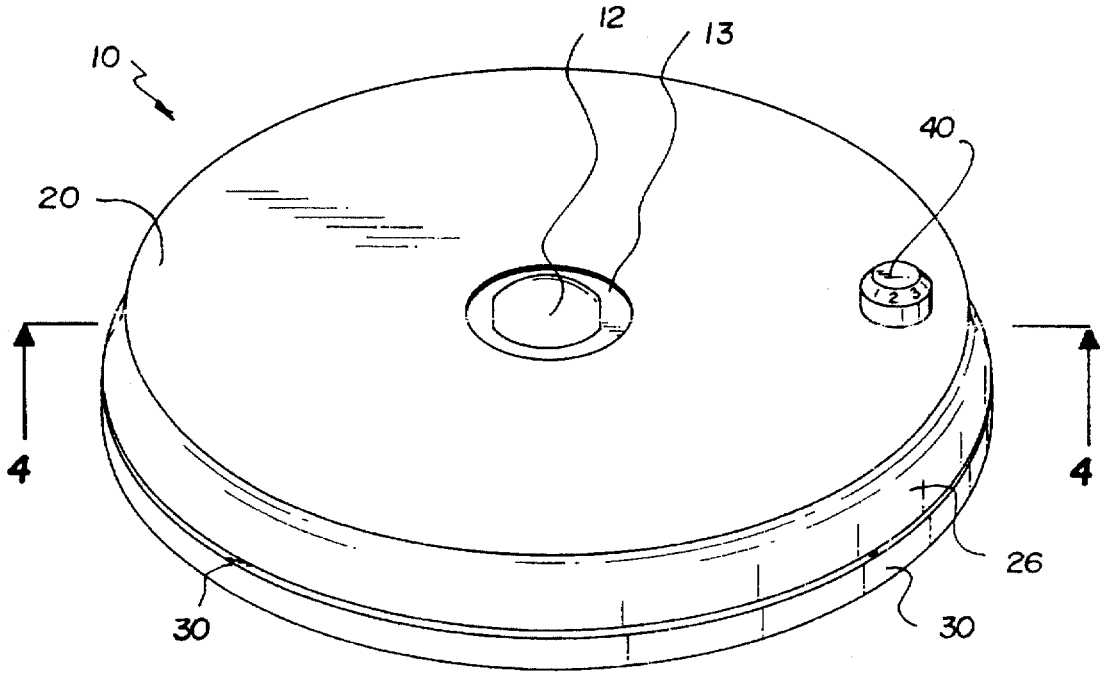
FIG. 2 is a top perspective view of a new Rotary Exercise Machine according to the present invention.
Figure 3:
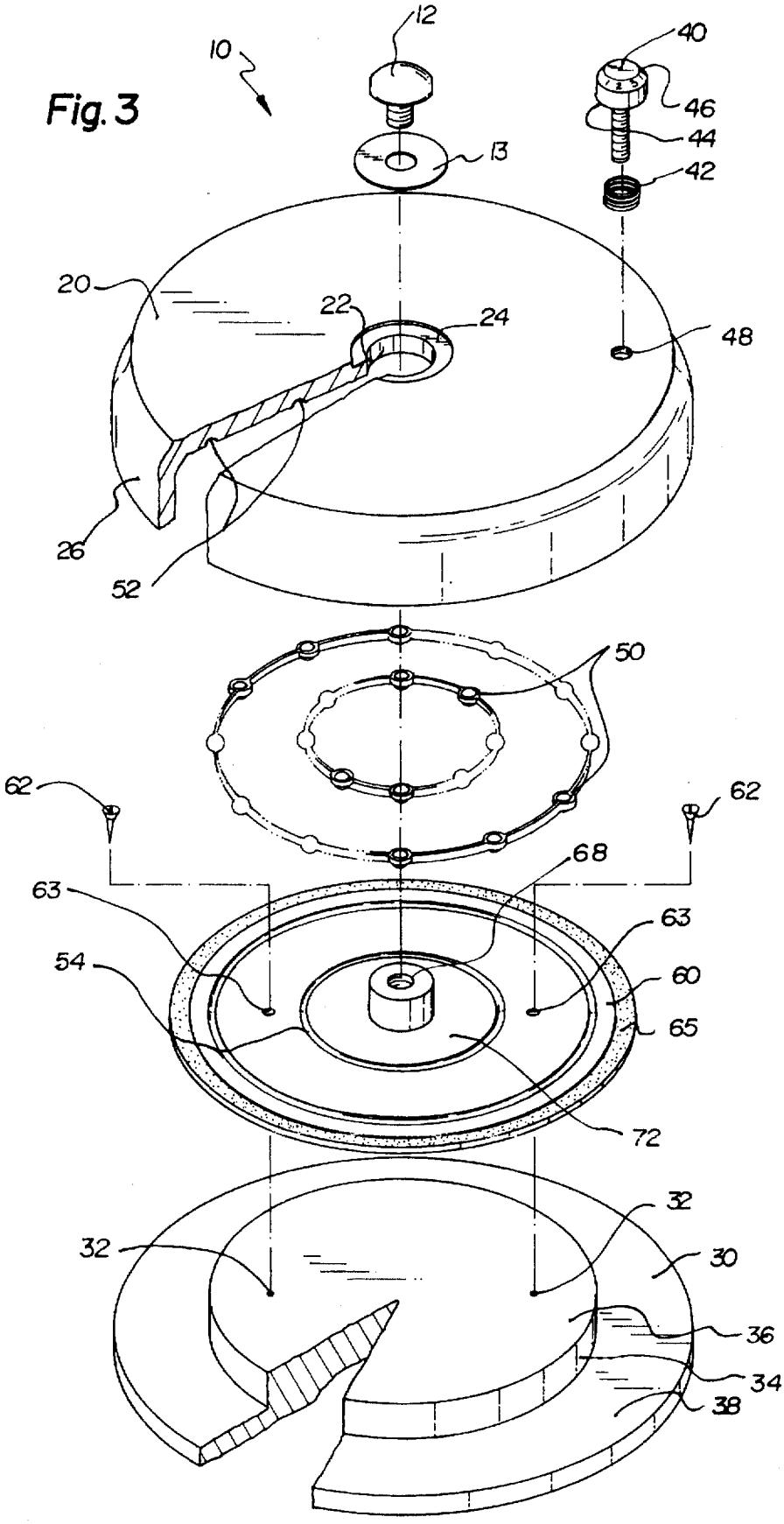
FIG. 3 is an exploded isometric illustration of the present invention.

With reference now to the drawings, and in particular to FIGS. 1 through 5 thereof, a new Rotary Exercise Machine embodying the principles and concepts of the present invention and generally designated by the reference numeral 10 will be described.

More specifically, it will be noted that the Rotary Exercise Machine 10 comprises a top plate 20, a bottom plate 30, a resistance plate 60, and a resistance knob 40.

As best illustrated in FIGS. 1 through 5, it can be shown that the bottom plate 30 is comprised of a lower base 38, a base shoulder 34, an upper base 36, and retaining apertures 32 where the upper base 36 is a raised extension of the lower base 38 and the base shoulder 34 integrally connects the upper base 36 to the lower base 38 and a bottom surface of the lower base 38 further includes a center hollow 39 which is further defined as a concave concentric indentation in the bottom surface of the lower base 38.

The lower base 38 and the upper base 36 are substantially flat surfaces and the lower base 38 concentrically surrounds the upper base 36.

The resistance plate 60 is fixedly and threadedly attached to the retaining apertures 32 of the bottom plate 30 by retaining screws 62. The resistance plate 60 further includes a plurality of ball bearing channels 54, at least one retaining screw aperture 63, a first resistance pad 64, a second resistance pad 65, a first brake disc surface 66, a second brake disc surface 67, and a hub shaft 68.

The resistance plate 60 is a substantially flat horizontal element and is concentric with the ball bearing channels 54, the first resistance pad 64, the second resistance pad 65, the first brake disc surface 66, the second brake disc surface 67, and the hub shaft 68.

The hub shaft 68 is located at the center of the resistance plate 60 and is further defined as an upward extension protrusion. The resistance plate 60 matingly and rotatably receives the top plate 20 and ball bearings 50 by rotatably mating with the hub shaft 68 and the ball bearing channels 54.

The top plate 20 is rotatably held to the resistance plate 60 by a pivot aperture 22 and a center screw 12 in conjunction with a slide surface washer 13. The top plate 20 is further comprised of ball bearing grooves 52, a brake aperture 48, a washer countersink surface 24, a top plate rim 26 and a brake reaction wall 28.

The ball bearing grooves 52 matingly receive and line up along a vertical centerline with the ball bearings 50 and the ball bearing channels 54. The top plate rim 26 is an integrally downward extension normal to the top plate 20 and further includes the brake reaction wall 28 which integrally extends inward from the top plate rim 26.

The first brake disc surface 66 and the second brake disc surface 67 are located at the outer perimeter of the resistance plate 60 and the first brake disc surface 66 is on the bottom side of the resistance plate 60 and the second brake disc surface 67 is on the top side of the resistance plate 60.

The first resistance pad 64 is fixedly attached to the lower end of a screw thread 44 and the second resistance pad 65 is attached to the upper side of the brake reaction wall 28 and oppose one another and are in spaced apart relationship and slidingly receive the resistance plate 60 adjacent to the first brake disc surface 66 and the second brake disc surface 67.

The top plate 20 further includes the resistance knob 40 which is integrally attached to an upper end of the screw thread 44. The screw thread 44 protrudes through a compression spring 42 which is biased between the resistance knob 40 and the top plate 20. The resistance knob 40 further includes tension settings 46 which give an indication as to the degree of braking effort.

Referring to FIG. 5, an alternate embodiment 74 can accomplish a rotable assembly by utilization of a tapered roller thrust bearing 70 which rotatably supports the top plate 20 by bearing down against a roller bearing thrust surface 72.

Furthermore, referring to FIGS. 4 and 5, the top plate 20 is assembled to the resistance plate 60 by sliding the brake reaction wall 28 under the resistance plate 60 with a distal edge of the top plate 20 up and proceeding by rolling the top plate 20 down to engage the hub shaft 68 and clear a distal arc of the resistance plate 60. To facilitate an alternate assembly, a tool clearance aperture 29 can be added to the top plate 20 to allow tool access for assembly of the retaining screws 62 and therefore allowing the resistance plate 60 to first be sub-assembled to the top plate 20.

In use, after the Rotary Exercise Machine 10 is assembled and operable, the user stands upon the exposed surface of the top plate 20 and begins a twisting exercise motion. Upon a first try, the user then adjusts the tension of the Rotary Exercise Machine 10 by operation of the resistance knob 40. After adjusting the tension of the Rotary Exercise Machine 10, the user begins to exercise.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Rotary Exercise Machine comprising: a top plate, a bottom plate, a resistance plate, and a resistance knob;

said top plate being rotatably mounted on said bottom plate, said resistance plate being fixedly mounted on said bottom plate between said top and bottom plates such that said top plate is rotatable with respect to said resistance plate;

said top plate having an aperture therethrough at a location radially spaced from the center of rotation between said top and bottom plates, said resistance knob including a threaded resistance knob shaft threadedly mounted in said aperture in said top plate, said top plate having a top plate rim extending in a substantially downward direction from the outer perimeter of said top plate and a brake reaction wall mounted to said top plate rim and extending inwardly in a direction substantially parallel to said top plate;

wherein a portion of said resistance plate is located between said brake reaction wall and the lower end of said resistance knob shaft such that selective rotation of said resistance knob advances said resistance knob shaft toward said brake reaction wall to produce a pinching of said resistance plate between said resistance knob shaft and said brake reaction wall to apply a variable amount of braking force between the resistance plate and the top plate and thereby vary the resistance exhibited by said top plate to rotate with respect to said bottom plate.

2. The Rotary Exercise Machine of claim 1, wherein the bottom plate is comprised of a lower base, a base shoulder, an upper base, and retaining apertures where the upper base is a raised extension of the lower base and the base shoulder integrally connects the upper base to the lower base and a bottom surface of the lower base further includes a center hollow which is further defined as a concave concentric indentation in the bottom surface of the lower base.

3. The Rotary Exercise Machine of claim 2, wherein the lower base and the upper base are substantially flat surfaces and the lower base concentrically surrounds the upper base.

4. The Rotary Exercise Machine of claim 3, wherein the resistance plate is fixedly and threadedly attached to the retaining apertures of the bottom plate by retaining screws and where the resistance plate further includes a plurality of ball bearing channels, at least one retaining screw aperture, a first resistance pad, a second resistance pad, a first brake disc surface, a second brake disc surface, and a hub shaft.

5. The Rotary Exercise Machine of claim 4, wherein the resistance plate is a substantially flat horizontal element and is concentric with the ball bearing channels, the first resistance pad, the second resistance pad, the first brake disc surface, the second brake disc surface, and the hub shaft.

6. The Rotary Exercise Machine of claim 5, wherein the hub shaft is located at the center of the resistance plate and is further defined as an upward extension protrusion and where the resistance plate matingly and rotatably receives the top plate and ball bearings by rotatably mating with the hub shaft and the ball bearing channels.

7. The Rotary Exercise Machine of claim 6, wherein the top plate is rotatably mounted to the resistance plate by a pivot aperture and a center screw [in conjunction with a slide surface washer] extending through the pivot aperture in said top plate, and wherein said top plate is further comprised of ball bearing grooves, a brake aperture, a washer countersink surface, a top plate rim, and a brake reaction wall.

8. A Rotary Exercise Machine comprising:

a top plate, a bottom plate, a resistance plate, and a resistance knob;

wherein the bottom plate is comprised of a lower base, a base shoulder, an upper base, and retaining apertures where the upper base is a raised extension of the lower base and the base shoulder integrally connects the upper base to the lower base and a bottom surface of the lower base further includes a center hollow which is further defined as a concave concentric indentation in the bottom surface of the lower base;

wherein the lower base and the upper base are substantially flat surfaces and the lower base concentrically surrounds the upper base;

wherein the resistance plate is fixedly and threadedly attached to the retaining apertures of the bottom plate by retaining screws and where the resistance plate further includes a plurality of ball bearing channels, at least one retaining screw aperture, a first resistance pad, a second resistance pad, a first brake disc surface, a second brake disc surface, and a hub shaft;

wherein the resistance plate is a substantially flat horizontal element and is concentric with the ball bearing channels, the first resistance pad, the second resistance pad, the first brake disc surface, the second brake disc surface, and the hub shaft;

wherein the hub shaft is located at the center of the resistance plate and is further defined as an upward extension protrusion and where the resistance plate matingly and rotatably receives the top plate and ball bearings by rotatably mating with the hub shaft and the ball bearing channels;

wherein the top plate is rotatably held to the resistance plate by a pivot top plate is rotatably aperture and a center screw in conjunction with a slide surface washer and where the top plate is further comprised of ball bearing grooves, a brake aperture, a washer countersink surface, a top plate rim, and a brake reaction wall; and wherein the ball bearing grooves matingly receive and line up along a vertical centerline with the ball bearings and the ball bearing channels and where the top plate rim is an integrally downward extension normal to the top plate and further includes the brake reaction wall which integrally extends inward from the top plate rim.

9. The Rotary Exercise Machine of claim 8, wherein the first brake disc surface and the second brake disc surface are located at the outer perimeter of the resistance plate and the first brake disc surface is on the bottom side of the resistance plate and the second brake disc surface is on the top side of the resistance plate.

10. The Rotary Exercise Machine of claim 9, wherein the first resistance pad is fixedly attached to the lower end of a screw thread and the second resistance pad is attached to the upper side of the brake reaction wall and oppose one another and are in spaced apart relationship and slidingly receive the resistance plate adjacent to the first brake disc surface and the second brake disc surface.

11. The Rotary Exercise Machine of claim 10, wherein the top plate further includes the resistance knob which is integrally attached to an upper end of the screw thread and where the screw thread protrudes through a compression spring which is biased between the resistance knob and the top plate and where the resistance knob further includes tension settings which give an indication as to the degree of braking force applied to the resistance plate by said resistance knob.

12. The Rotary Exercise Machine of claim 1 including a tapered roller thrust bearing which rotatably supports the top plate by bearing down against a roller bearing thrust surface on said bottom plate.

13. The Rotary Exercise Machine of claim 8, wherein the top plate includes a tool clearance aperture therethrough to allow tool access to the retaining screws.

* * * * *